United States Patent [19]

Nishimura

[11] 4,430,005

[45] Feb. 7, 1984

[54] SPEECH SYNTHESIZER TIMEPIECE WITH ALARM FUNCTION

[75] Inventor: Kosuke Nishimura, Yamatokoriyama, Japan

[73] Assignee: Sharp Kabushiki Kaisha, Osaka, Japan

[21] Appl. No.: 287,559

[22] Filed: Jul. 28, 1981

[30] Foreign Application Priority Data

Jul. 28, 1980 [JP] Japan ..... 55-197180[U]

[51] Int. Cl.[3] ..... G04B 19/30

[52] U.S. Cl. ..... 368/67; 368/12; 368/73

[58] Field of Search ..... 368/63, 251; 364/710; 179/15 A, 15 M

[56] References Cited

U.S. PATENT DOCUMENTS 3,420,051 1/1969 Matteson ..... 368/63
3,704,345 11/1972 Coker et al. ..... 179/15 A
3,835,640 9/1974 Hughes, Jr. ..... 368/63
4,259,668 3/1981 Nishimura et al. ..... 364/710

FOREIGN PATENT DOCUMENTS 2911853 4/1979 Fed. Rep. of Germany ..... 368/63

OTHER PUBLICATIONS

Sprechende Uhr, Funkschau, 17/81, pp. 63–66, Kraekel.

*Primary Examiner*—Bernard Roskoski
*Attorney, Agent, or Firm*—Birch, Stewart, Kolasch & Birch

[57] ABSTRACT

An alarm timepiece is disclosed which is capable of setting a plurality of alarm settings and selecting which of a plurality of messages should be outputted in association with a respective alarm setting. Selected messages are output by a speech synthesis technique, and an exchangeable ROM cassette is provided for containing speech-synthesizing data characteristic of the content of the messages.

2 Claims, 3 Drawing Figures

SPEECH SYNTHESIZER TIMEPIECE WITH ALARM FUNCTION

BACKGROUND OF THE INVENTION

This invention relates to a speech synthesizer timepiece with the function of providing an alarm announcement with an accompanying audio message.

Conventional alarm timepieces are generally adapted to provide a plurality of alarm settings and output tunes or melodies. However, the user may forget what purpose he set such alarm setting or settings.

OBJECTS AND SUMMARY OF THE INVENTION

Accordingly, it is an object of the present invention to provide an alarm timepiece capable of providing alarm messages in the form of synthesized human voice.

It is another object of the present invention to provide an alarm timepiece which has an exchangeable data-ROM cassette containing the maximum number of common words associated with alarm messages depending upon its category use in view of utilization efficiency and cost performance. Since the contents of messages differ from user to user, the volume of data necessary to store in a single device for intended use for a wide range of users including from children to businessmen is too ineconomic with regard cost, space and utilization efficiency.

BRIEF DESCRIPTION OF THE DRAWINGS

The present invention will be better understood from the detailed description given hereinbelow and the accompanying drawings which are given by way of illustration only.

DETAILED DESCRIPTION OF THE INVENTION

Figure 1:
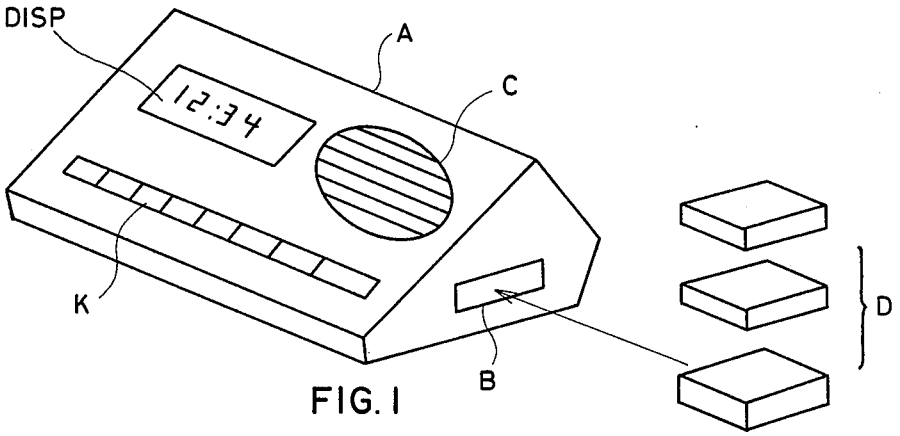
FIG. 1 is a perspective view of an embodiment of the present invention.

Referring now to FIG. 1, there is illustrated an embodiment of the invention, which includes a timepiece body A, a timepiece display DISP, a speaker opening C, a family of keys K for time adjustment, alarm settings, message selection and so forth, and a cassette inlet B for receipt of a message ROM cassette D which plays an important role for the present invention.

Figure 2:
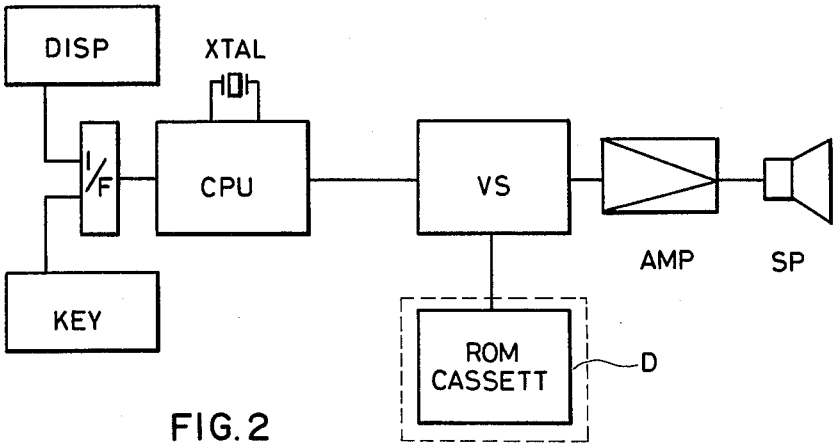
FIG. 2 is a block diagram of the illustrated embodiment.

FIG. 2 is a block diagram, showing a central processor unit CPU operating for the purpose of time-keeping, monitoring alarm settings and so forth, a quartz oscillator XTAL for the purpose of developing a timing pulse, both of which are coupled with the display DISP and the keys K via an interface circuit I/F. Sound-related data are contained within an exchangeable ROM cassette D and the output of a speech synthesizer circuit VS is fed to a loudspeaker SP via an amplifier AMP.

The following tables illustrate a few examples of sets of alarm-related messages. While the contents of these messages are different, they are assigned to the same order of key codes. The speech synthesizer circuit VS is compatible with these codes whereby one may determine which alarm message to deliver and where to search for the address of the ROM associated with that message.

| KEY CODE | FOR BUSINESSMEN USE |
|---|---|
| 1 | it's time for meeting |
| 2 | please call your customer |
| 3 | today is deadline for payments |
| 4 | please telex |
| 5 | visit your customer |
| 7 | collect money |
| 8 | turn in a report |

| KEY CODE | FOR MANAGERS USE |
|---|---|
| 1 | it's time for meeting |
| 2 | it's time for your lecture |
| 3 | prepare for business trip |
| 4 | it's time for dinner appointment |

| KEY CODE | FOR CHILDREN USE |
|---|---|
| 1 | prepare for tommorow's lessons |
| 2 | did you finish assignment |
| 3 | it's time to play |
| 4 | good night |

Figure 3:
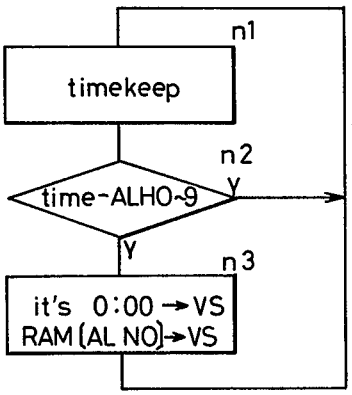
FIG. 3 is a flow chart for explanation of operation of the illustrated embodiment.

FIG. 3 shows a flow chart. While keeping-time ($n_1$), the timepiece executes the step $n_2$ which in turn determines if the real time is in agreement with any one of the alarm settings. If the real time agrees with any one of the alarm settings, then the timepiece provides an audible message "it's now 0:00" and generates a message identifying number while searching the consecutive message numbers (the above mentioned key codes) through the step $n_3$. The speech synthesizer VS fetches desired ones of the data from the ROM cassette for the delivery of an audible message.

The present invention offers the following advantages.

1. The meanings of audible messages are more clear than in the case of times or melodies.
2. Because the data ROM is a cassette configuration, the timepiece body is compatible with all kinds of ROM cassettes.
3. The ROM cassette optionally is selectable depending upon the user's personal taste and intended use. Nothing more than exchange of the ROM cassette is necessary. A number of voluminous timepieces need not be manufactured or displayed in a show window; this gives a significant advantage for sales.
4. When the user wishes to move the timepiece, he need only to carry the timepiece body and only a desired one of the compact cassettes.

The invention being thus described, it will be obvious that the same may be vaired in many ways. Such variations are not to be regarded as a departure from the spirit and scope of the invention, and all such modifications are intended to be included within the scope of the following claims.

What is claimed is:

1. An alarm timepiece comprising:

means for setting a plurality of alarm times;

a removable and exchangeable read only memory device associated with said timepiece for storing data representing a plurality of messages;

speech synthesizer means associated with said exchangeable read only memory device for outputting verbal messages represented by said data at said alarm times; and means for selecting which of said plurality of messages is outputted by said speech synthesizer means at each of said alarm times.

2. An alarm timepiece as in claim 1, wherein each of said plurality of messages is represented by a code, and said selecting means comprises means for inputting a selected code to said timepiece and means for retrieving data from said read only memory device representing a message corresponding to said selected code.

* * * * *